US011318457B2

(12) United States Patent
Döbele

(10) Patent No.: US 11,318,457 B2
(45) Date of Patent: May 3, 2022

(54) MANUAL METERING DEVICE

(71) Applicant: IKA-Werke GmbH & Co. KG, Staufen (DE)

(72) Inventor: Philip Döbele, Freiburg (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 450 days.

(21) Appl. No.: 16/349,786

(22) PCT Filed: Oct. 2, 2017

(86) PCT No.: PCT/EP2017/001162
§ 371 (c)(1),
(2) Date: May 14, 2019

(87) PCT Pub. No.: WO2018/086721
PCT Pub. Date: May 17, 2018

(65) Prior Publication Data

US 2019/0374936 A1 Dec. 12, 2019

(30) Foreign Application Priority Data

Nov. 14, 2016 (DE) ..... 10 2016 121 814.6

(51) Int. Cl.
*B01L 3/02* (2006.01)

(52) U.S. Cl.
CPC ..... *B01L 3/0224* (2013.01); *B01L 2200/148* (2013.01); *B01L 2300/025* (2013.01); *B01L 2300/0832* (2013.01)

(58) Field of Classification Search
CPC ..... B01L 3/0224; B01L 2300/025; B01L 2300/0832; B01L 2300/026; B01L 2200/148
See application file for complete search history.

(56) References Cited

U.S. PATENT DOCUMENTS 4,501,163 A 2/1985 MacDermott et al.
5,320,810 A 6/1994 Al-Mahareeq et al.
(Continued)

FOREIGN PATENT DOCUMENTS

DE 4335863 C1 2/1995
DE 20321525 U1 1/2008
(Continued)

OTHER PUBLICATIONS

International Search Report from PCT Application No. PCT/EP2017/001162, dated Nov. 29, 2017.

*Primary Examiner* — Christopher Adam Hixson
(74) *Attorney, Agent, or Firm* — Budzyn IP Law, LLC

(57) ABSTRACT

In order for it to be possible for the user of a manual metering apparatus (1) to be provided with different options for adjusting a manual metering apparatus (1), in particular a pipette, the manual metering apparatus (1) according to the invention is proposed, in the case of which the operating element (5) for operating the volume adjusting mechanism (3) of the manual metering apparatus (1) is constructed in two pieces and comprises a display adjusting element (7) which is connected to the volume display (4) of the manual metering apparatus (1), and the volume adjusting element (8) which is connected to the volume adjusting mechanism (3) of the manual metering apparatus (1). The display adjusting element (7) and the volume adjusting element (8) are connected to one another via the releasable coupling (9), with the result that a volume adjustment leads to a corresponding adjustment of the volume display and vice versa, as long as the coupling (9) is closed. If the coupling (9) is released, the display adjusting element (7) and the volume adjusting element (8) can be adjusted or actuated independently from one another in order to adjust the manual metering apparatus (1) (FIG. 5).

17 Claims, 4 Drawing Sheets

(56) References Cited

U.S. PATENT DOCUMENTS

| | | | |
|---|---|---|---|
| 5,531,131 | A | 7/1996 | Sabloewski |
| 2008/0223108 | A1 | 9/2008 | Kobayashi et al. |
| 2013/0199312 | A1 | 8/2013 | Wilmer et al. |
| 2016/0303557 | A1 | 10/2016 | LaCroix |

FOREIGN PATENT DOCUMENTS

| | | | |
|---|---|---|---|
| EP | 1743701 | A1 | 1/2007 |
| WO | 2011025399 | A2 | 3/2011 |

MANUAL METERING DEVICE

FIELD OF THE INVENTION

The invention relates to a manual metering device, in particular a pipette, having a dispensing mechanism for dispensing a defined fluid volume (called the dispensing volume in the following text), in particular a liquid volume, having a volume adjusting mechanism for adjusting the dispensing volume, having a volume display for displaying a set dispensing volume, and having an operating element for operating the volume adjusting mechanism.

BACKGROUND OF THE INVENTION

Manual metering apparatuses of this type are previously known from the prior art in different embodiments. The manual metering apparatuses are usually calibrated and adjusted after their manufacture. For reasons of quality assurance, the manual metering apparatuses should be calibrated several times per year and possibly adjusted.

If, in the case of the calibration, the setpoint values do not coincide with the determined actual values, the manual metering apparatuses have to be adjusted. In the case of some manual metering apparatuses, an adjustment by way of the end user is not provided. In the case of other manual metering apparatuses, there is the possibility to perform the adjustment of the respective manual metering apparatus by way of a special tool. Other manual metering apparatuses can also be adjusted without a tool.

In principle, the adjustment of the manual metering apparatuses can take place in two ways. In both ways, an alignment is established between the volume display of the manual metering apparatus and the fluid volume which can actually be dispensed or pipetted.

In a first variant for adjusting a manual metering apparatus which is used, above all, in the case of pipettes with a fixed dispensing volume, the fluid volume which is to be dispensed is set to a defined setpoint value. A gravimetric calibration of the manual metering apparatus then takes place. If an excessively large deviation of the gravimetrically determined actual value from the preset setpoint value is determined, the dispensing mechanism of the manual metering apparatuses is adapted correspondingly, in order to match the actual value to the setpoint value. To this end, for example, a plunger stroke of a plunger of the dispensing mechanism can be changed. The plunger stroke change which is required for the adjustment and is as a rule performed by way of a screwing or rotational movement of elements of the dispensing mechanism or the volume adjusting mechanism can be determined via calculation formulae. This is associated with a certain amount of effort, however. This procedure for adjustment is applied in the case of many manual metering apparatuses with a variable dispensing volume.

In a second variant for adjustment which is provided in the case of other manual metering apparatuses, the volume display is matched to the actually dispensed fluid volume. The dispensing volume is thus first of all set to a defined setpoint value. Subsequently, a calibration is carried out and an actual value is determined. The value which is displayed on the volume display is then set to the actually measured value. An adjustment of the dispensing mechanism by way of the volume adjusting mechanism does not take place here.

Thus, for example, a plunger stroke of a plunger of the dispensing mechanism remains unchanged in the case of said procedure. The adjustment takes place here "from setpoint value to actual value". After the adjustment is concluded, the original setpoint value is set again, in order to carry out the calibration again for control purposes.

Whereas calculations are necessary in the case of the first-described variant for adjusting a manual metering apparatus, in order to perform the adaptations which are required for the adjustment on the dispensing mechanism, the second variant is distinguished by its simplicity. The two procedures nevertheless have their advantages.

SUMMARY OF THE INVENTION

It is therefore an object of the invention to provide a manual metering apparatus of the type mentioned at the outset which provides the user with the option of carrying out both the one type and the other type of adjustment.

In order to achieve said object, a manual metering apparatus of the type defined at the outset having the means and features of claim 1 is proposed. In particular, in order to solve said object in the case of a pipette of the type defined at the outset, it is proposed that the operating element comprises a display adjusting element which is connected to the volume display, and a volume adjusting element which is connected to the volume adjusting mechanism, the display adjusting element and the volume adjusting element being connected to one another via a releasable coupling in the normal use position of the manual metering apparatus, with the result that a volume adjustment leads to a corresponding adjustment of the volume display and vice versa, and it being possible for the display adjusting element and the volume adjusting element to be adjusted independently of one another in the case of a released coupling in order to adjust the manual metering apparatus. In this way, it is possible for the display adjusting element which remains connected to the volume display even in the case of a released coupling to be adjusted independently of the volume adjusting element which for its part remains connected to the volume adjusting mechanism in the case of a released coupling, independently of one another, and thus for the volume display and the volume adjusting mechanism to be actuated independently of one another.

Thus, after a calibration of the manual metering apparatus and after a determination of an actual value of the dispensed fluid volume in the case of an unchanged volume display, an adaptation of the fluid volume to be dispensed can be performed by way of a corresponding change of the dispensing mechanism with the aid of the volume adjusting element.

If the above-described second variant for adjusting the manual metering apparatus is to be carried out, this is also possible by way of the manual metering apparatus according to the invention. Here, the dispensed fluid volume can then once again first of all be determined in a calibration step, and the actual value of the dispensed fluid volume can be determined. Subsequently, in the case of an unchanged dispensing mechanism and volume adjusting mechanism, the value which is indicated on the volume display for the dispensing volume is adapted with the aid of the display adjusting element which can be adjusted independently of the volume adjusting element, and the displayed value can thus be matched to the determined actual value.

It can be advantageous if the manual metering apparatus has a housing, in which at least the dispensing mechanism and the volume adjusting mechanism are arranged.

It can additionally be advantageous if the volume adjusting element is also set up for actuating the dispensing mechanism. In this way, a dual function can be assigned to the volume adjusting element. Firstly, an actuation of the volume adjusting mechanism with the aid of the volume adjusting element is possible. Secondly, the volume adjusting element can also be used for actuating and triggering the dispensing mechanism of the manual metering apparatus.

It can be provided here, in particular, that the volume adjusting element is configured as a rotatable pushbutton. A rotational movement of the pushbutton can be transmitted to the volume adjusting mechanism in order to adjust the fluid volume to be dispensed. An axial movement, for example a pressure movement, of the volume adjusting element which is configured as a pushbutton can be transmitted to the dispensing mechanism in order to dispense a preset fluid volume. The volume adjusting element can be configured as a rotatable pipetting button which is connected firstly to the volume adjusting mechanism and secondly to the dispensing mechanism of the manual metering apparatus.

The display adjusting element can be configured as a display adjusting wheel. Comfortable and precise operation of the display adjusting element is possible in this way. If the display adjusting element or display adjusting wheel forms a leadthrough for the volume adjusting element which is preferably configured as a rotatable pushbutton, in which leadthrough the volume adjusting element is guided and is arranged in the use position, torque which is transmitted to the display adjusting element can also be transmitted reliably to the volume adjusting element in the case of a closed coupling between the display adjusting element and the volume adjusting element. In addition, this can thus result in a particularly compact design of the manual metering apparatus.

The coupling of the manual metering apparatus can be a radial coupling. It can preferably be configured as a positively locking radial coupling. The radial coupling can comprise at least one coupling element and at least one mating coupling element, the at least one coupling element being arranged on the volume adjusting element, and the at least one mating coupling element being arranged on the display adjusting element.

It is possible here that the at least one coupling element on the volume adjusting element is a tooth segment, and the mating coupling element on the display adjusting element is a mating toothing system which fits the tooth segment. The mating toothing system can be configured as an internal toothing system. The coupling element, in particular the tooth segment, can preferably be capable of being moved radially to the outside into a coupling position counter to a restoring force of a restoring element, in particular an annular spring, in which coupling position said coupling element engages into the mating toothing system.

The volume adjusting element can comprise a sleeve which has a plug-in opening at one actuating end for a coupling pin of the coupling. The at least one coupling element of the coupling can be moved by way of plugging of the coupling pin into the plug-in opening counter to the restoring force of the restoring element into its coupling position on the mating coupling element and can be fixed there.

It can be provided here that the coupling element which is at least preferably configured as a tooth segment reaches through an opening in the sleeve with a projection into the interior of the sleeve of the volume adjusting element. The sleeve and/or the at least one coupling element can have a guide groove for the restoring element, in which guide groove the restoring element, in particular the annular spring, is arranged in a guided manner. The restoring element which is preferably configured as an annular spring can thus be arranged in said guide groove on the coupling element and the sleeve, and can be laid from the outside around the sleeve of the volume adjusting element.

If the coupling pin is then introduced through the plug-in opening into the interior of the sleeve of the volume adjusting element, the coupling pin displaces that end of the coupling element which reaches into the interior of the sleeve to the outside in the radial direction. This takes place counter to the action of the restoring element which is preferably configured as an annular spring. It is possible in this way that the coupling element is returned automatically into a decoupled position with the aid of the restoring element as soon as the coupling pin is removed from the sleeve of the volume adjusting element.

On its upper side which faces away from the plug-in opening, the abovementioned coupling pin can have a pressure face for actuating the volume adjusting element. It is therefore possible to exert pressure on the volume adjusting element in a comfortable way, in particular in order to actuate and in order to trigger the dispensing mechanism.

The volume adjusting mechanism of the manual metering apparatus can have a spindle with a thread, the dispensing mechanism of the manual metering apparatus can have a plunger which can be moved in a cylinder of the manual metering apparatus, and the volume adjusting element can have a mating thread which fits the thread. The spindle can be connected via the thread and the mating thread to the volume adjusting element, and the spindle can for its part be connected to the plunger. It is possible in this way to change a screwing depth between the volume adjusting element and the spindle and therefore an insertion depth of the plunger into the cylinder and therefore a plunger stroke by way of a rotation of the volume adjusting element. The spindle is preferably mounted non-rotatably and axially displaceably in a (for example, the abovementioned) housing of the manual metering apparatus.

The operating element can be moved out of a locked starting position, in which a volume adjustment is prevented and the dispensing mechanism can be actuated by way of the volume adjusting element, into a volume adjusting position, in which the volume adjusting mechanism and/or the volume display can be actuated with the aid of the volume adjusting element and/or the display adjusting element. In this way, an unintended volume adjustment of the manual metering apparatus is prevented if the manual metering apparatus is to be used merely in regular use only for dispensing a defined fluid volume which has already been preset.

If the mating coupling element (in particular, if it is configured as a mating toothing system) has a greater axial extent than the at least one coupling element which is preferably configured as a tooth segment, it is possible to displace the volume adjusting element axially relative to the display adjusting element by way of the coupling element in order to actuate the dispensing mechanism, without the coupling being released.

It can be advantageous if the volume adjusting element and the display adjusting element can be rotated relative to one another in the case of a released coupling.

In order for it to be possible for a volume adjustment and also a volume display adjustment to be performed over a great range in as comfortable and rapid a manner as possible, it can be advantageous if a gear mechanism is connected between the display adjusting element and the volume display, in particular between the display adjusting element and a mechanical counter mechanism of the volume display. It can be advantageous here if the gear mechanism has a transmission ratio which is less than 1, that is to say, for example, a revolution of the display adjusting element can be stepped up into ten revolutions of a counter wheel which is connected to an output of the gear mechanism. The gear mechanism can be, for example, a single-stage or preferably also a multiple-stage planetary gear mechanism.

The manual metering apparatus can additionally have an ejection mechanism for ejecting a pipette tip which is plugged onto a free, preferably conical shank end of the manual metering apparatus. It is possible in this way for pipette tips of this type to be ejected without having to be touched directly. The ejection mechanism can be operated particularly comfortably if it can be actuated by way of the display adjusting element. This can take place, in particular, by way of axial displacement or pressing of the display adjusting element out of a starting position into an ejecting position. The display adjusting element can therefore also assume a dual function, namely firstly an adjustment of the volume display and, in the case of a closed coupling, also an adjustment of the volume adjusting mechanism, and additionally also an actuation and triggering of the ejecting mechanism.

BRIEF DESCRIPTION OF THE DRAWINGS

In the following text, one exemplary embodiment of the manual metering apparatus according to the invention will be described in greater detail using the figures, in which, in a partially greatly diagrammatic illustration.

Figure 1:
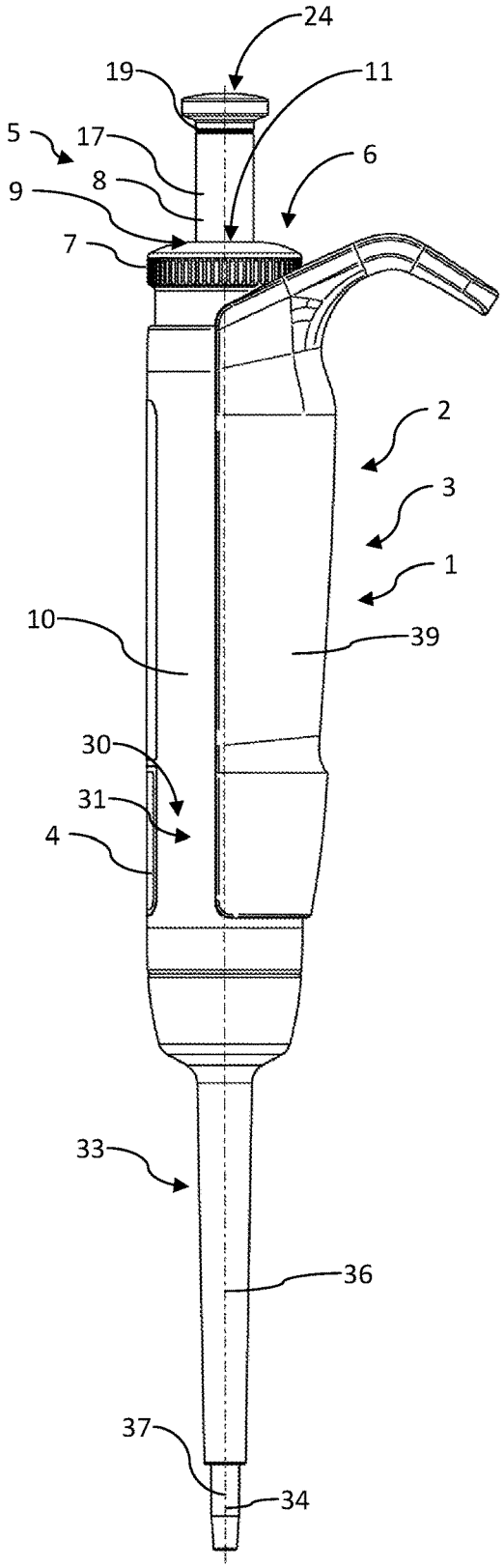
FIGS. 1 and 2.
Figure 2:
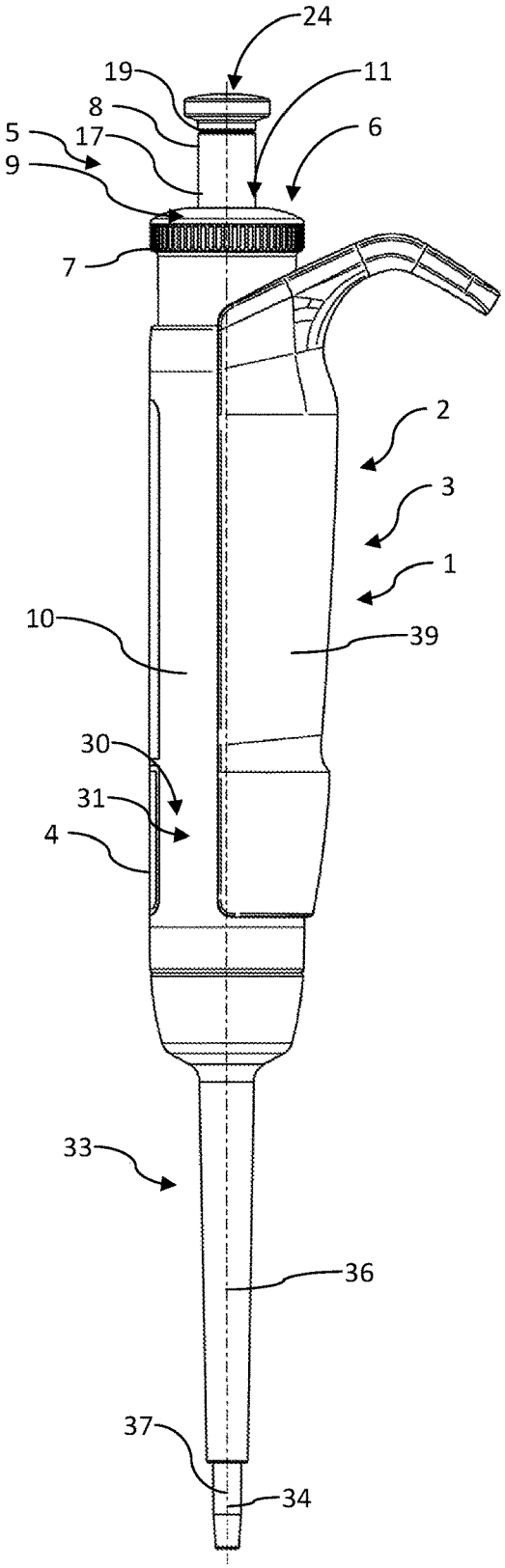
Figure 3:
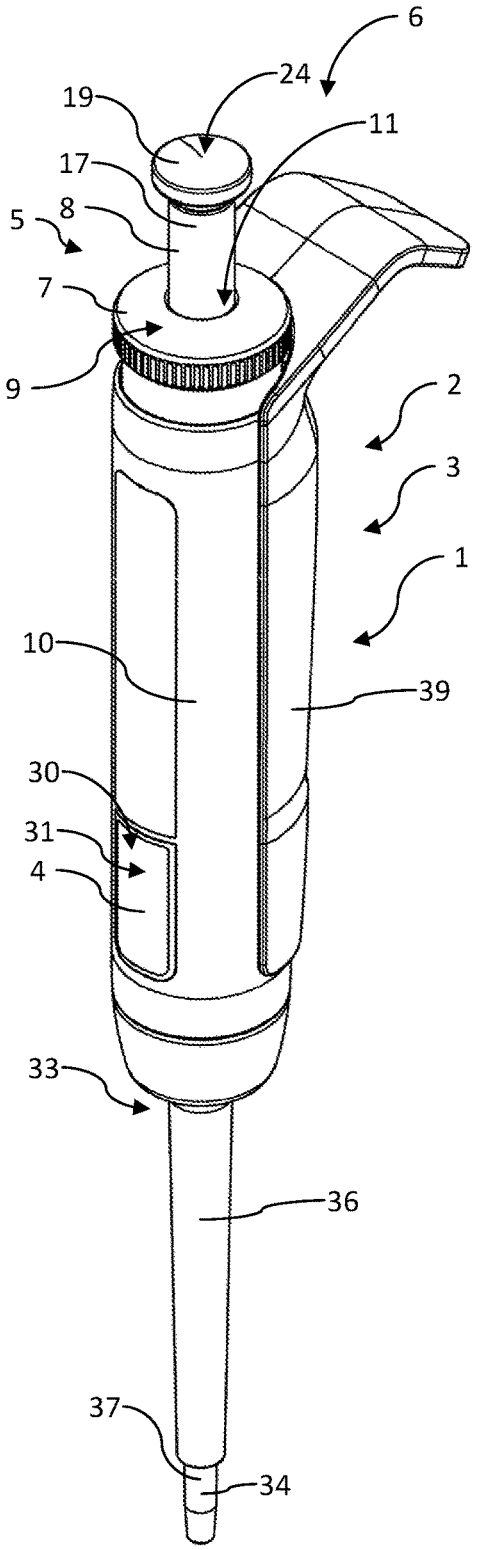
Figure 4:
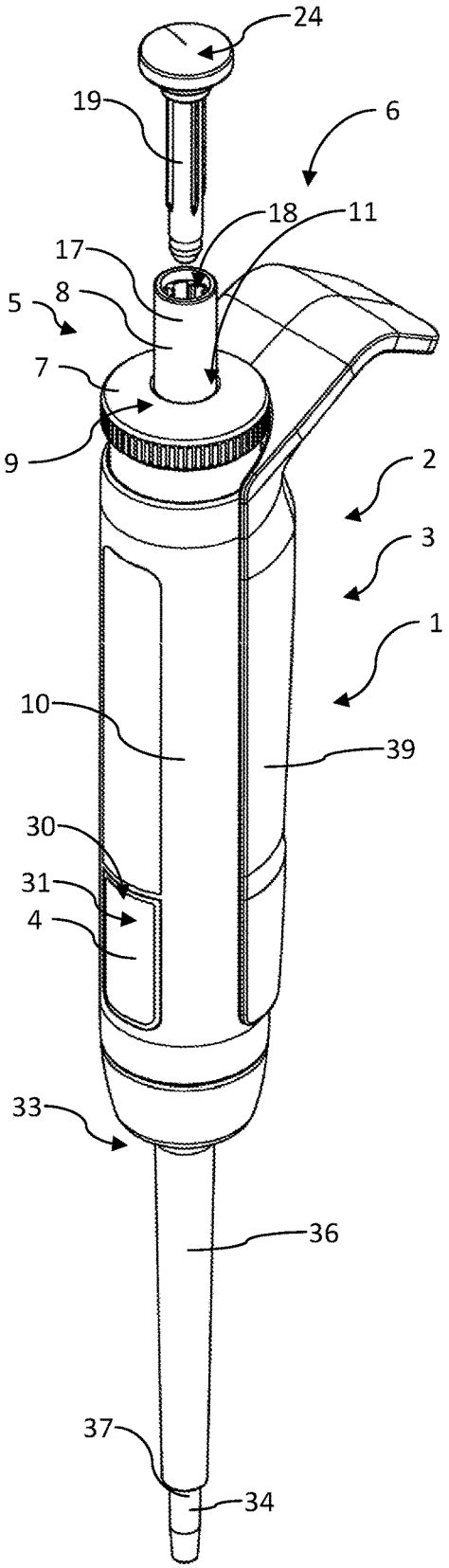
Figure 5:
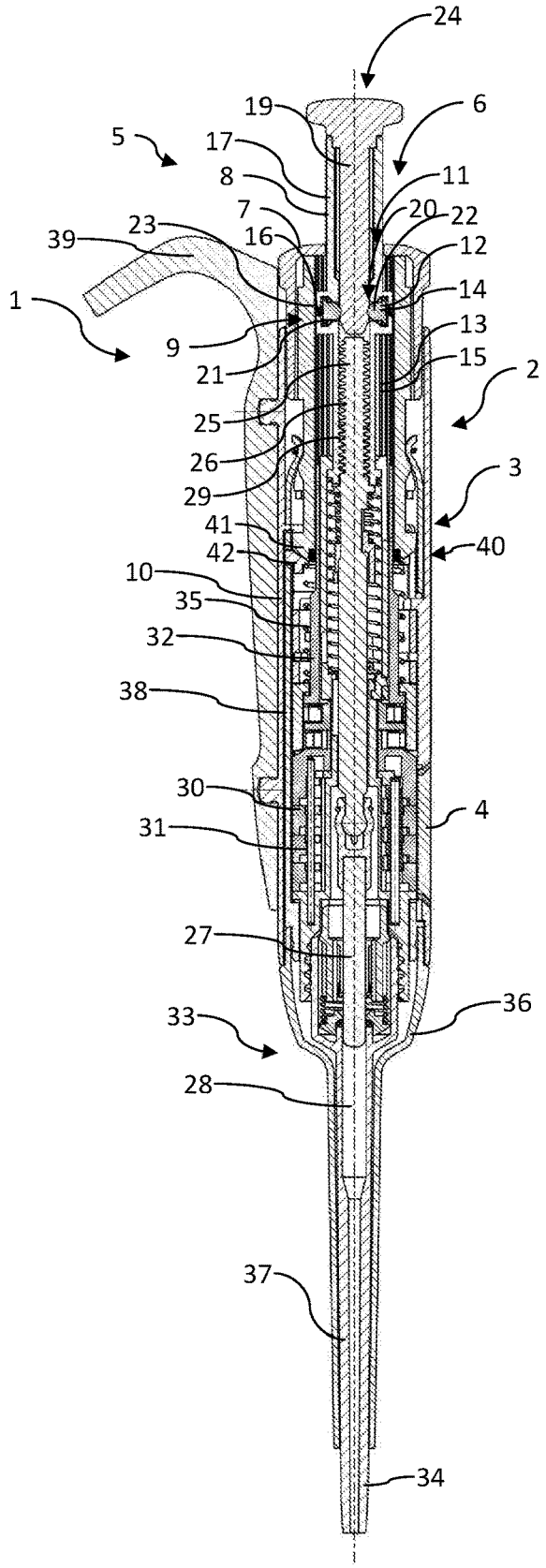
Figure 6:
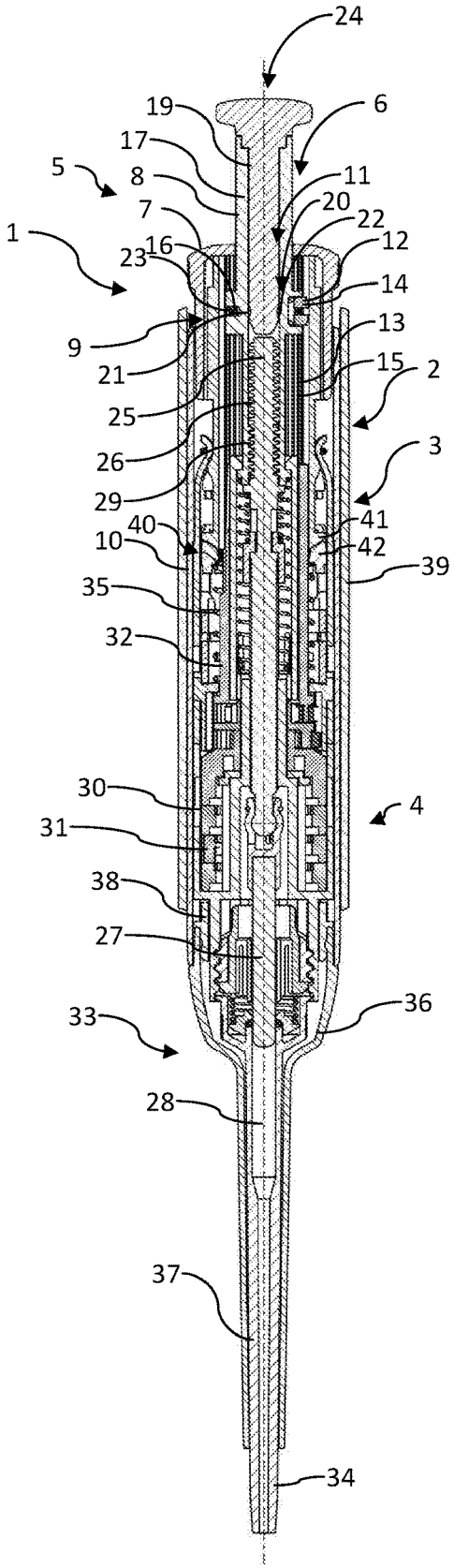
Figure 8:
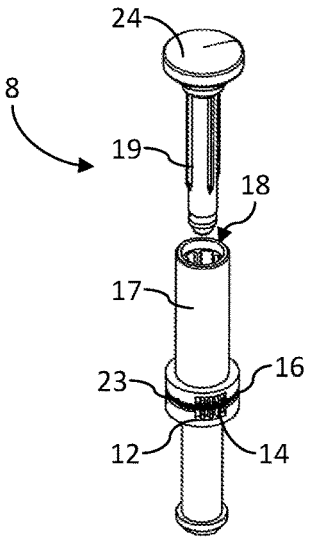
Figure 9:
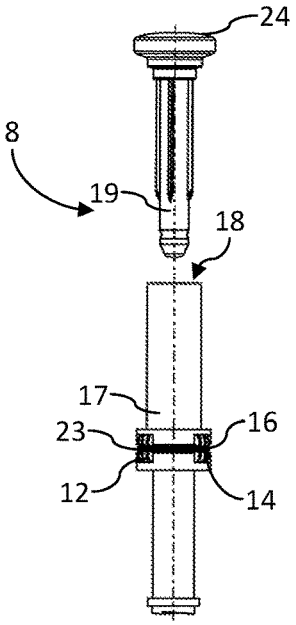
Figure 10:
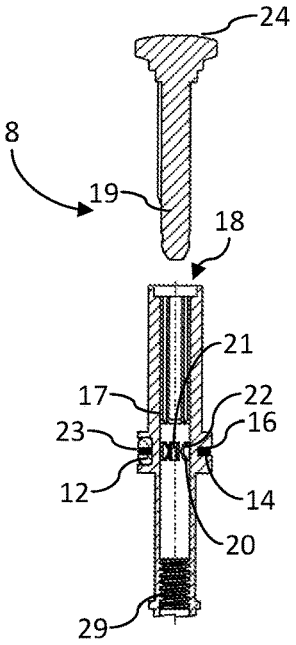
Figure 11:
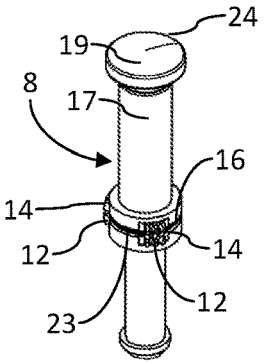
Figure 12:
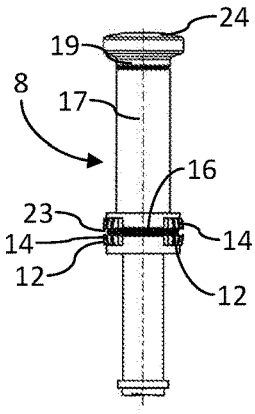
Figure 13:
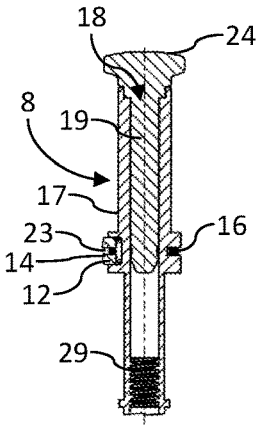

in each case show a side view of a manual metering apparatus according to the invention which is configured as a pipette; an operating element of the manual metering apparatus can be seen in its locked starting position in FIG. 1, and a display adjusting element of said operating element can be seen in a volume adjusting position in FIG. 2, FIGS. 3 and 4:

in each case show a perspective view of the pipette which is shown in FIGS. 1 and 2; a coupling pin which can be plugged through a plug-in opening of a sleeve of a volume adjusting element of the operating element can be seen above the plug-in opening in FIG. 4, FIGS. 5 and 6:

show two sectional illustrations which are rotated by 90 degrees with respect to one another of the pipette which is shown in the preceding figures,

FIG. 7:

shows a perspective bottom view of the display adjusting element,

FIGS. 8 to 10:

show different views of the volume adjusting element; the coupling pin and two of a total of three coupling elements which are configured as tooth segments and are arranged uniformly on the circumference of a sleeve of the volume adjusting element can be seen, and FIGS. 11 to 13:

show different views of the volume adjusting element which is shown in FIGS. 8 to 10 with the coupling pin in its use position, in which it is introduced through the plug-in opening into the sleeve of the volume adjusting element.

DETAILED DESCRIPTION OF THE INVENTION

FIGS. 1 to 6 show a manual metering apparatus which is denoted overall by 1 and is configured as a pipette. Said manual metering apparatus 1 has a dispensing mechanism 2 for dispensing a defined fluid volume, in particular a liquid volume, a volume adjusting mechanism 3 for adjusting the dispensing volume, and a volume display 4 for displaying a set dispensing volume. In order to operate the volume adjusting mechanism 3 and also to correspondingly change the volume display 4, the manual metering apparatus 1 is provided with an operating element 5 which is arranged in a top region 6 of the manual metering apparatus such that it can be reached by a user.

The operating element 5 is constructed in two pieces and comprises a display adjusting element 7, which is connected to the volume display 4, and a volume adjusting element 8 which is connected to the volume adjusting mechanism 3. A releasable coupling 9 is provided between the display adjusting element 7 and the volume adjusting element 8, which coupling 9 connects said two elements 7 and 8 to one another. As a consequence, a volume adjustment leads to a corresponding adjustment of the volume display and vice versa, at least as long as the releasable coupling 9 is closed and the display adjusting element 7 is connected to the volume adjusting element 8. In the case of a released coupling 9, the display adjusting element 7 and the volume adjusting element 8 can be adjusted and/or actuated independently of one another in order to adjust the manual metering apparatus 1. The individual constituent parts of the coupling 9 are shown in greater detail in the FIGS. 7 to 13.

The manual metering apparatus 1 has a housing 10, in which at least the dispensing mechanism 2 and the volume adjusting mechanism 3 and also further components of the manual metering apparatus 1 are arranged. It becomes clear, in particular, on the basis of the sectional illustrations of the manual metering apparatus 1 in accordance with FIGS. 5 and 6 that the manual metering apparatus 1 is a mechanically manually actuable pipette.

The volume adjusting element 8 is set up for actuating the dispensing mechanism 2 of the manual metering apparatus 1. For this purpose, the volume adjusting element 8 is configured as a rotatable pushbutton. A rotational movement of the pushbutton can be transmitted to the volume adjusting mechanism 3 in order to adjust the fluid volume to be dispensed. An axial movement, in particular a pressure movement, of the pushbutton can be transmitted to the dispensing mechanism 2 in order to dispense a preset fluid volume which can also be called a dispensing volume.

The display adjusting element 7 is configured as a display adjusting wheel. The display adjusting wheel 7 forms a leadthrough 11 for the volume adjusting element 8 which is configured as a rotatable pushbutton, in which leadthrough 11 the volume adjusting element 8 is arranged in a guided manner. The coupling 9 is a positively locking radial coupling which comprises at least one coupling element 12 and at least one mating coupling element 13. The at least one coupling element 12 is arranged on the volume adjusting element 8, and the at least one mating coupling element 13 is arranged on the display adjusting element 7. The at least one coupling element 12 on the volume adjusting element 8 is a tooth segment 14. The mating coupling element 13 on the display adjusting element 7 is configured as a mating toothing system 15 which fits the tooth segment 14. Said mating toothing system 15 is an internal toothing system in accordance with FIG. 7.

FIGS. 8 to 13 illustrate that the total of three tooth segments 14 which are arranged uniformly on the circumference of the volume adjusting element 8 can be moved radially to the outside into a coupling position counter to a restoring force of a restoring element 16 which is configured as an annular spring in the present exemplary embodiment.

In said coupling position, the tooth segments 14 engage into the mating toothing system 15, as a result of which the coupling 9 is closed.

The volume adjusting element 8 comprises a sleeve 17 which, at an actuating end, has a plug-in opening 18 for a coupling pin 19 of the coupling 9. Said coupling pin 19 can be seen particularly clearly in FIGS. 8 to 13. By way of plugging of the coupling pin 19 into the plug-in opening 18, said coupling pin 19 passes into its use position and leads to it being possible for the coupling elements 12 to pass counter to the restoring force of the restoring element 16 into their coupling position on the mating coupling element 13 and to be held there.

Overall, the coupling 9 has three coupling elements 12 which are arranged uniformly on the circumference of the sleeve 17 in the form of in each case one tooth segment 14. Each of the tooth segments 14 reaches with one end 20 through an opening 21 into the interior of the sleeve 17, with the result that a projection 22 at the end 20 of each tooth segment 14 protrudes into the interior of the sleeve 17. It is possible in this way that, in its use position, in which it is introduced through the plug-in opening 18 into the interior of the sleeve 17, the coupling pin 19 displaces the total of three tooth segments 14 radially to the outside via their projections 22.

This takes place counter to the restoring force of the restoring element 16 which is configured as an annular spring, is placed over the sleeve 17 on the outer side, and is held in a guided manner within an outer-side guide groove 23 of the sleeve 17, which guide groove 23 continues into the tooth segments 14. The guide groove 23, the restoring element 16 and the coupling elements 12 are arranged in or on a retaining shoulder 17*a* of the sleeve 17.

On its upper side which faces away from the plug-in opening 18, the coupling pin 19 has a pressure face 24. The pressure face 24 serves for actuating the volume adjusting element 8, in particular when the latter is to be actuated in order to trigger the dispensing mechanism 2 of the manual metering apparatus 1.

The volume adjusting mechanism 3 comprises a spindle 25 with a thread 26, the dispensing mechanism 2 comprises a plunger 27 which is guided movably in a cylinder 28 of the manual metering apparatus 1, and the volume adjusting element 8 comprises a mating thread 29 which fits the thread 26. Here, the mating thread 29 is provided at an end of the sleeve 17, which end faces away from the actuating end. The spindle 25 is connected via its thread 26 and the mating thread 29 to the sleeve 17 of the volume adjusting element 8. The spindle 25 is for its part connected to the plunger 27, with the result that, in the case of a rotation of the volume adjusting element 8, a screwing depth of the threads 26 and 29 between the volume adjusting element 8 and the spindle 25 and an insertion depth of the plunger 27 and/or a plunger stroke of the plunger 27 within the cylinder 28 can be changed. Here, the spindle 25 is mounted non-rotatably but axially displaceably in the housing 10 of the manual metering apparatus 1.

The display adjusting element 7 of the operating element 5 can be moved axially upward out of a starting position (shown in FIGS. 1, 3, 4, 5 and 6) into a volume adjusting position (shown in FIG. 2). The mechanism for this purpose can be seen clearly in the sectional illustrations of the manual metering apparatus 1 in accordance with FIGS. 5 and 6. A volume adjustment is prevented in the locked starting position, whereas the dispensing mechanism 2 can still be actuated by way of the volume adjusting element 8. An unintentional volume adjustment during dispensing of a defined fluid volume by way of the manual metering apparatus 1 is prevented in this way.

In the volume adjusting position which is shown in FIG. 2, the volume adjusting mechanism 3 can be actuated with the aid of the operating element 5. This takes place by way of rotation of the display adjusting element 7 or the volume adjusting element 8 which is connected to the display adjusting element 7 via the coupling 9. Since the display adjusting element 7 is interlocked or connected to the volume adjusting element 8 in the case of a closed coupling 9, an actuation of the volume adjusting mechanism 3 by way of rotation of one of the two elements 7 or 8 also leads to a corresponding change of the volume display 4.

Figure 7:
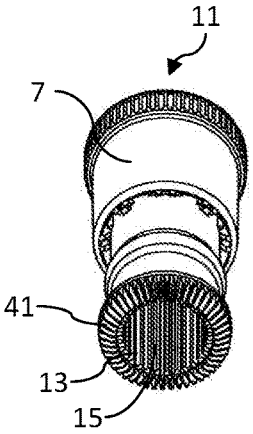

In particular, FIG. 7 illustrates that the mating coupling element 13 which is configured as a mating toothing system 15 has a greater axial extent than the coupling elements 12. In this way, the volume adjusting element 8 can be displaced axially relative to the display adjusting element 7 with its coupling elements 12 in order to actuate the dispensing mechanism 2, without the coupling 9 being released in the process or as a result. The volume adjusting element 8 and the display adjusting element 7 can be rotated relative to one another in the case of a released coupling 9. If, however, the display adjusting element 7 is left in its locked starting position in accordance with FIGS. 1, 3, 4, 5 and 6, free rotation of the display adjusting element 7 is prevented. The locking of the display adjusting element 7 takes place with the aid of a spur toothing system 40 which is produced by way of engagement of teeth 41 which are configured on an underside of the display adjusting element 7 into a toothed ring 42 which is arranged within the housing 10.

If the coupling pin 9 is pulled upward out of its use position within the sleeve 17 through the plug-in opening 18, the coupling 9 is opened and the volume adjusting element 8 can be rotated independently of the position of the display adjusting element 7 in order to change the plunger stroke of the plunger 27.

A gear mechanism 30 is connected between the display adjusting element 7 and the volume display 4. Specifically, the gear mechanism 30 is arranged between the display adjusting element 7 and a mechanical counter mechanism 31 of the volume display 4. A rotational movement of the display adjusting element 7 is transmitted with the aid of a transmission element 32 to the gear mechanism 30 and the mechanical counter mechanism 31 of the volume display 4. The gear mechanism 30 is a planetary gear mechanism which, in a comparatively compact installation space, enables a sufficiently great transmission ratio of, for example, 1 to 10 between the display adjusting element 7 and a first counter wheel of the counter mechanism 31 of the volume display 4.

In addition, the manual metering apparatus 1 comprises an ejection mechanism 33 for ejecting a pipette tip which is not shown in the figures and is plugged onto a free, conically tapering shank end 34 of the manual metering apparatus 1. The ejection mechanism 33 can be actuated by way of the display adjusting element 7. This takes place by way of axial displacement of the display adjusting element 7 out of a starting position into an ejecting position. Here, said axial displacement of the display adjusting element 7 out of its starting position into its ejecting position takes place counter to the restoring force of a restoring spring 35, by way of which the display adjusting element 7 can be moved automatically out of its ejecting position back into the starting position.

Part of the ejection mechanism 33 is an ejection sleeve 36. The latter can be displaced axially relative to a shank 37 of the manual metering apparatus 1 and is connected via a connecting element 38 to the display adjusting element 7 in such a way that a return movement (brought about by way of the restoring spring 35) of the display adjusting element 7 out of the ejecting position into the starting position can be transmitted to the ejection sleeve 36.

A removable, hook-shaped grip 39 is arranged on an outer side of the housing 10.

In order for it to be possible for different options for adjusting a manual metering apparatus 1, in particular a pipette, to be provided for the user, the manual metering apparatus 1 according to the invention is proposed, in the case of which the operating element 5 for operating the volume adjusting mechanism 3 of the manual metering apparatus 1 is constructed in two pieces, and comprises the display adjusting element 7, which is connected to the volume display 4 of the manual metering apparatus, and the volume adjusting element 8 which is connected to the volume adjusting mechanism 3 of the manual metering apparatus 1. The display adjusting element 7 and the volume adjusting element 8 are connected to one another via the releasable coupling 9, with the result that a volume adjustment leads to a corresponding adjustment of the volume display and vice versa, as long as the coupling 9 is closed. If the coupling 9 is released, the display adjusting element 7 and the volume adjusting element 8 can be actuated independently of one another in order to adjust the manual metering apparatus 1.

What is claimed is:

1. A manual metering apparatus (1) comprising in particular a pipette extending along a longitudinal axis, having a dispensing mechanism (2) for dispensing a defined liquid volume, having a volume adjusting mechanism (3) for adjusting a dispensing volume, having a volume display (4) for displaying a set dispensing volume, and having an operating element (5) for operating the volume adjusting mechanism (3), wherein the operating element (5) comprises a display adjusting element (7) which is connected to the volume display (4) and a volume adjusting element (8) which is connected to the volume adjusting mechanism (3), wherein the display adjusting element (7) and the volume adjusting element (8) being connected to one another via a releasable coupling (9) such that a volume adjustment by the volume adjusting element (8) leads to a corresponding adjustment of the volume display (4) by the display adjusting element (7) and vice versa, and, wherein, with the releasable coupling (9) released, the display adjusting element (7) and the volume adjusting element (8) are adjustable independently of one another to adjust the manual metering apparatus (1), with the volume display (4) and the volume adjusting mechanism (3) being actuated independently of one another, wherein the releasable coupling (9) is a positively locking radial coupling which comprises at least one coupling element (12) and at least one mating coupling element (13), the at least one coupling element (12) being arranged on the volume adjusting element (8), and the at least one mating coupling element (13) being arranged on the display adjusting element (7), and, wherein the at least one coupling element (12) on the volume adjusting element (8) is a tooth segment (14) which is radially displaceable transversely to the longitudinal axis, and the mating coupling element (13) on the display adjusting element (7) is a mating toothing system (15) which includes a plurality of grooves parallel to the longitudinal axis, each of the grooves being configured to fit the tooth segment (14).

2. The manual metering apparatus (1) as claimed in claim 1, wherein the manual metering apparatus (1) has a housing (10), in which at least the dispensing mechanism (2) and the volume adjusting mechanism (3) are arranged.

3. The manual metering apparatus (1) as claimed in claim 1, wherein the volume adjusting element (8) is configured as a rotatable pushbutton such that a rotational movement of the pushbutton allows for selectively adjusting the fluid volume to be dispensed with such selection being transmitted to the volume adjusting mechanism (3), and such that axial movement of the pushbutton causes dispensing a preset fluid volume by transmitting to the dispensing mechanism (2).

4. The manual metering apparatus (1) as claimed in claim 3, wherein the display adjusting element (7) defines a leadthrough (11) in which the volume adjusting element (8), configured as the rotatable pushbutton, is guided and arranged.

5. The manual metering apparatus (1) as claimed in claim 1, wherein the volume adjusting element (8) comprises a sleeve (17) which, at an actuating end, has a plug-in opening (18) for a coupling pin (19) of the releasable coupling (9), wherein the at least one coupling element (12) is outwardly radially displaceable by plugging the coupling pin (19) into the plug-in opening (18), counter to a restoring force of a restoring element (16).

6. The manual metering apparatus (1) as claimed in claim 5, wherein, on an upper side which faces away from the plug-in opening (18), the coupling pin (19) has a pressure face (24) for actuating the volume adjusting element (8).

7. The manual metering apparatus (1) as claimed in claim 1, wherein the volume adjusting mechanism (3) has a spindle (25) with a thread (26), the dispensing mechanism (2) has a plunger (27) which can be moved in a cylinder (28) of the manual metering apparatus (1), and the volume adjusting element (8) has a mating thread (29) which fits the thread (26), the spindle (25) being connected via the thread (26) and the mating thread (29) to the volume adjusting element (8), and the spindle (25) being connected to the plunger (27), with the result that, in the case of a rotation of the volume adjusting element (8), a screwing depth between the volume adjusting element (8) and the spindle (25) and an insertion depth of the plunger (27) into the cylinder (28) can be changed, the spindle (25) being mounted non-rotatably and axially displaceably in a housing (10) of the manual metering apparatus (1).

8. The manual metering apparatus (1) as claimed in claim 1, wherein the display adjusting element (7) is movable between a locked starting position into a volume adjusting position, wherein a volume adjustment is prevented with the display adjusting element (7) in the locked starting position with the dispensing mechanism (2) being actuatable by the volume adjusting element (8), and, wherein, at least one of the volume adjusting mechanism (3) and the volume display (4) is actuatable with the display adjusting element (7) being in the volume adjusting position.

9. The manual metering apparatus (1) as claimed in claim 1, wherein the mating toothing system (15) has a greater axial extent than the at least one coupling element (12), so that the volume adjusting element (8) can be displaced axially relative to the display adjusting element (7) by way of the at least one coupling element (12) in order to actuate the dispensing mechanism (2), without the releasable coupling (9) being released.

10. The manual metering apparatus (1) as claimed in claim 1, wherein the volume adjusting element (8) and the display adjusting element (7) can be rotated relative to one another in the case of the releasable coupling (9).

11. The manual metering apparatus (1) as claimed in claim 1, wherein a gear mechanism (30) is connected between the display adjusting element (7) and the volume display (4).

12. The manual metering apparatus (1) as claimed in claim 1, wherein the manual metering apparatus (1) has an ejection mechanism (33) for ejecting a pipette tip which is plugged onto a free shank end (34) of the manual metering apparatus (1).

13. The manual metering apparatus (1) as claimed in claim 1, wherein the tooth segment (14) is outwardly radially displaceable counter to a restoring force of a restoring element (16).

14. The manual metering apparatus (1) as claimed in claim 13, wherein the at least one coupling element (12) has a guide groove (23) for receiving the restoring element (16).

15. The manual metering apparatus (1) as claimed in claim 5, wherein the at least one coupling element (12) has a projection (22), with the sleeve (17) having at least one opening (21) for the at least one coupling element (12), the projection (22) being formed to reach through the opening (21) into the interior of the sleeve (17).

16. The manual metering apparatus (1) as claimed in claim 11, wherein the gear mechanism is one of a single-stage planetary gear mechanism or a multiple-stage planetary gear mechanism.

17. The manual metering apparatus (1) as claimed in claim 12, wherein the ejection mechanism (33) is actuated by axial displacement of the display adjusting element (7).

* * * * *